US008749594B2

(12) United States Patent
Kyriakos et al.

(10) Patent No.: US 8,749,594 B2
(45) Date of Patent: Jun. 10, 2014

(54) AVIONICS DEVICE DISPLAY DIMMING SYSTEM AND METHOD

(75) Inventors: Constantinos Kyriakos, Albuquerque, NM (US); Sean Rieb, Albuquerque, NM (US)

(73) Assignee: Aspen Avionics, Inc., Albuquerque, NM (US)

( * ) Notice: Subject to any disclaimer, the term of this patent is extended or adjusted under 35 U.S.C. 154(b) by 518 days.

(21) Appl. No.: 12/843,683

(22) Filed: Jul. 26, 2010

(65) Prior Publication Data

US 2011/0148749 A1 Jun. 23, 2011

Related U.S. Application Data

(60) Provisional application No. 61/228,601, filed on Jul. 26, 2009, provisional application No. 61/367,041, filed on Jul. 23, 2010, provisional application No. 61/367,058, filed on Jul. 23, 2010.

(51) Int. Cl.
*G09G 5/10* (2006.01)

(52) U.S. Cl.
USPC ..... 345/690; 345/87; 345/102

(58) Field of Classification Search
USPC ..... 345/87–10, 102
See application file for complete search history.

(56) References Cited

U.S. PATENT DOCUMENTS

| | | | | |
|---|---|---|---|---|
| 6,281,895 | B1 * | 8/2001 | Jeong | 715/810 |
| 2003/0214242 | A1 | 11/2003 | Berg-Johansen | |
| 2005/0190142 | A1 * | 9/2005 | Ferguson | 345/102 |
| 2006/0022993 | A1 * | 2/2006 | Hammond | 345/590 |
| 2006/0244636 | A1 | 11/2006 | Rye et al. | |
| 2008/0184166 | A1 | 7/2008 | Getson | |

OTHER PUBLICATIONS

Written Opinion of the International Searching Authority for PCT/US2010/043285, mailed Jan. 14, 2011.

* cited by examiner

*Primary Examiner* — Alexander Eisen
*Assistant Examiner* — Cory Almeida
(74) *Attorney, Agent, or Firm* — Kutak Rock LLP; Bryan P. Stanley

(57) ABSTRACT

The present general inventive concept provides a system and method to use alpha blending properties of a graphics processor to dim the display, effectively darkening it with neutral color overlays, beyond the last hardware dimming step.

13 Claims, 1 Drawing Sheet

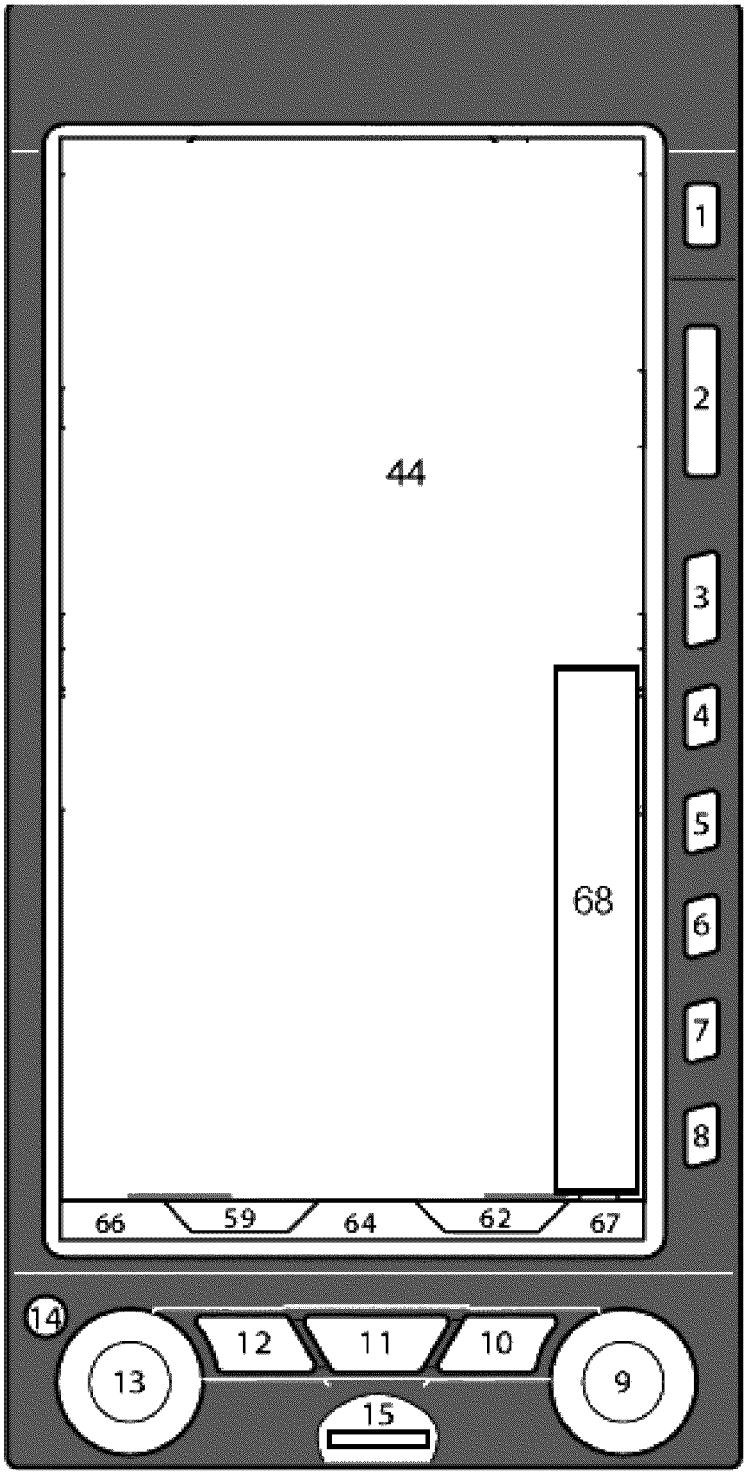
1
2
44
3
4
5
68
6
7
8
66
59
64
62
67
14
12
11
10
13
9
15

AVIONICS DEVICE DISPLAY DIMMING SYSTEM AND METHOD

CROSS-REFERENCES

This application claims the benefit of, and priority based upon, U.S. Provisional Patent Applications, Ser. No. 61/228,601, entitled "LCD Display Dimming System and Method", filed Jul. 26, 2009, and Ser. No. 61/367,041, entitled "Avionics Display", filed Jul. 23, 2010, and U.S. Provisional Patent Application Ser. No. 61/367,058, entitled "Avionics Display", filed Jul. 23, 2010, the entire disclosures of which are herein incorporated by reference.

BACKGROUND

1. Field

The present general inventive concept relates to display systems and methods display devices such as displays for electronic avionics devices. More particularly, the inventive concept relates to a system and method to use the graphics display processor functions of an electronic avionics device (or other display device) to dim an avionics display of the device to the lowest possible levels during night flying (such that observation of data displayed by the display may be observed) without the need for very wide dynamic range backlight circuitry.

2. Description of Related Art

LCD type displays have become common in electronic aviation devices. As LCD panels produce no light of their own, they require an external lighting mechanism (backlight) to be easily visible. On most LCD displays, this consists of a cold cathode florescent lamp that is situated behind the LCD panel. More recently, LED backlit LCD displays have appeared in LCD displays as an alternative to the conventional florescent lamp backlight. LED backlight schemes also allow for a slimmer panel than on conventional displays. LCD displays for electronic avionics devices currently use very large dynamic range (>1000:1) dimming hardware to go between maximum brightness required (such that observation of data displayed by the display may be observed) while in direct sunlight, to the minimum required during night flight. The minimum display brightness of such conventional displays is limited by the capabilities of the LCD hardware, which requires a minimum amount of power to drive the light. Particularly with respect to LED backlight schemes, the minimum power required to drive the backlight results in a display brightness that is often too bright for use in avionics equipment, which is often utilized in conditions in which very little, if any, ambient light is present. If the light output or glare of the avionics display is too bright when used in minimal ambient light conditions that often are present in nighttime flight, the pilot must continuously adjust or refocus his/her vision between the avionics display and the nighttime sky. This can be inconvenient and even unsafe. Therefore, it would be beneficial to provide a means for increasing the dimming capabilities of an avionics display (or other similar display) beyond that of the associated hardware backlight drivers.

To minimize the glare of displays, many display manufacturers include a night mode feature in which the color scheme of an item being displayed is modified in low ambient light situation. In such night mode features, darker colors, such as black, are used to replace brighter colors such as green, blue, etc. Such modes result in lower contrast and often less detail of items displayed on the screen. Therefore, it would be beneficial to provide a display that reduces glare without changing the color arrangement of items being displayed on the display screen.

SUMMARY

This invention provides a method to use alpha blending properties of a graphics processor to dim the display, effectively darkening it with neutral color overlays, beyond the last hardware dimming step.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

These and/or other aspects and utilities of the present general inventive concept will become apparent and more readily appreciated from the following description of the embodiments, taken in conjunction with the accompanying drawings. For the purpose of illustration, forms of the present general inventive concept which are presently preferred are shown in the drawings; it being understood, however, that the general inventive concept is not limited to the precise arrangements and instrumentalities shown. In the drawings:

FIG. 1 is an exemplary embodiment of an avionics device of the present general inventive concept.

DETAILED DESCRIPTION

The present general inventive concept provides systems and methods that relate to a display for electronic avionics devices, or the like.

The present general inventive concept provides a display connected to a controller of an avionics device (or the like) and a graphics processor including alpha blending properties.

The alpha blending properties of the graphics processor enable dimming of the display via effectively darkening the display with neutral color overlays beyond the last hardware dimming step.

In other words, the present general inventive concept permits dimming of a display past the lowest dim setting of other hardware to which the display is connected. At the same time, the present general inventive concept reduces display glare and/or permits display dimming without changing the colors of items being displayed.

The exemplary embodiment of the present general inventive concept is implemented as a software algorithm, e.g., computer readable codes, on a computer readable medium, such as a firmware stored in the memory of the electronic avionics device of FIG. 1, and/or of the electronic avionics devices shown and described in U.S. Provisional Patent Application Ser. No. 61/367,041, entitled "Avionics Display", filed Jul. 23, 2010, or U.S. Provisional Patent Application Ser. No. 61/367,058, entitled "Avionics Display", filed Jul. 23, 2010 (the entire disclosures of which are incorporated herein by reference). For instance, the alpha blending properties of the device shown in FIG. 1 are stored in a database such that, upon request by a user, or upon a request by an auto-diming subroutine, for dimming of display 44, the graphic processor extracts one of a plurality of blending options stored in the database and generates an appropriate display of data that is dimmer than display of the data prior to the request.

FIG. 1 shows an exemplary embodiment of an avionics device of the present general inventive concept having a display, screen 44, knobs 9, 13 and buttons 1, 2, 3, 4, 5, 6, 7, 8, 10, 11, 12 to control various functions of the device, including, but not limited to the brightness of display screen 44. The device of FIG. 1 includes five hot keys 4, 5, 6, 7, and 8 to the right of the screen 44 which may be used to toggle various features on and off. The function of each hot key 4, 5, 6, 7, and 8 is indicated by the label on the screen 44 to the left of each button at location 68. Three additional buttons above the hot keys control entering and exiting the main menu 3, setting and/or adjusting the map range 2, and reversion or manual power control 1. The device of FIG. 1 also includes an automatic dimming photocell 14 and a microSD card slot 15.

In an embodiment shown in FIG. 1, display screen 44 is a backlit LCD. In one such embodiment the backlight scheme utilizes one or more LED's. The LED(s) includes an LED driver to power the backlight hardware that includes a dynamic range of brightness including a maximum brightness level and a minimum brightness level. The minimum brightness level represents a brightness created by use of a generally minimum amount of power required to drive the LED(s) used in the LCD backlight. The dynamic range of brightness of the hardware can be controlled by one or more of the buttons or knobs on the avionics device of FIG. 1 that provide input to a processor of the device that controls hardware brightness (e.g. by controlling power level to the backlight), and/or can also be controlled automatically by an auto-dimming subroutine that is stored in the firmware of the device and is accessed by a control processor of the device to control brightness of the display. The control processor of the device is operably connected to screen 44 of the device to control the backlight brightness level and/or power supplied to the backlight driver and to the photocell 14 to provide data input to the control processor regarding ambient light conditions surrounding the device. The control processor utilizes the ambient light data in the auto-dimming subroutine to automatically adjust the brightness level of the backlight based upon a hardware target brightness level value stored in a database accessible by the processor that corresponds to an ambient light value measured by photocell 14. It will be appreciated that the hardware target brightness level value associated with a specific ambient light value in the database may be values preprogrammed into the device, or alternatively may be stored in the database via input from the user. In one preferred embodiment, the hardware target brightness level values are generated by a subroutine in the processor based upon a user's selection of a preferred brightness level for a specific ambient light value. In such an embodiment, the subroutine stores the preferred brightness level value for the specific ambient light value in the database and utilizes that preferred brightness level value to populate preferred brightness level values for all other ambient light values by either increasing or decreasing the preferred brightness level value by an amount proportional to the change in ambient light value.

In the embodiment of the avionics device discussed above with respect to FIG. 1, the minimum brightness level that may be obtained by the backlight hardware of the device is stored in a database accessible by the control processor of the device. In the auto-dimming embodiment, the database is the same database in which preferred brightness level values are stored. In another embodiment, a separate database is utilized for storing the minimum brightness level. Once the hardware target brightness level reaches the minimum brightness level obtainable by the backlight, and further brightness reduction is requested (either by the auto-dimming subroutine or through user input via one or more of the buttons/knobs, the processor activates the graphics processor to further reduce the brightness level of the display. It will be appreciated that the graphics processor and device processor may be multiple subroutines of a single processor hardware component, or alternatively may be multiple hardware components.

The brightness level of the display is reduced below the minimum brightness level obtainable by the hardware via a neutral color (such as black, gray, brown, etc.—preferably a color that generally filters all colors of light) translucent overlay (foreground) that is combined with the background image of the avionics information displayed by the device of FIG. 1 (e.g. Navigation Map (NAV MAP), Terrain (TERR), Traffic (TRFC), WX-500 (STRIKES), Data Link Weather (WEATHER), Secondary HSI, or others) utilizing an alpha bending process subroutine of the graphics processor. The neutral color overlay utilizes the same color across every pixel of display 44 for a given brightness level, such that the brightness level is reduced below the minimum hardware brightness level by a consistent amount across the entire screen. The graphics processor accesses a database of stored opacity (or transparency) values for the neutral color overlay that corresponds to the brightness level requested by the user input (via control knobs/buttons) or by the auto-dimming subroutine. As the requested brightness level goes below the minimum hardware brightness level, the opacity of the overlay is iteratively increased from 0% to 100% (or translucency is iteratively decreased from 100% to 0%) across the entire display 44 and alpha blended with the background image. As the opacity of the overlay increases, the brightness level output from the display 44 decreases, while the brightness level of the backlight remains unchanged. Brightness level is increased by decreasing the opacity.

It will be appreciated that the general inventive concept, as described herein, may be, and in certain embodiments is, used in conjunction with any or all of the general inventive concepts described in U.S. Provisional Patent Application Ser. Nos. 61/228,608, entitled "Information Page Selection System and Method", 61/228,599, entitled "Altitude Marker System and Method", 61/228,598, entitled "Multifunction Avionics Display User Interface Method", 61/228,597, entitled "Dynamic Topography Resolution System and Method of Display", 61/228,610, entitled "Reversionary Architecture System and Method", and Ser. No. 61/228,603, entitled "Pitot Pressure Sensing System and Method", all six filed Jul. 26, 2009, the entire disclosures of which are herein incorporated by reference, and also U.S. Provisional Patent Application Ser. Nos. 61/367,041, entitled "Avionics Display", filed Jul. 23, 2010, and 61/367,058, entitled "Avionics Display", both filed Jul. 23, 2010, the entire disclosures of which are herein incorporated by reference.

The exemplary embodiment of the present general inventive concept is implemented as a software algorithm, e.g., computer readable codes, on a computer readable medium, such as on firmware of the avionics device discussed above. Various other embodiments of the present general inventive concept can be embodied as computer readable codes on a computer readable medium and/or computer readable recording medium (collectively "computer readable recording medium" hereafter). The computer readable recording medium may include any data storage device suitable to store data that can be thereafter read by a computer system. Examples of the computer readable recording medium include, but are not limited to, a read-only memory (ROM), a random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Various embodiments of the present general inventive concept may also be embodied in hardware or in a combination of hardware and software. Although described herein in connection with an avionics device, it will be appreciated that the instant inventive concept may also be embodied in any device that utilizes a display in which display brightness is adjusted, including but not limited to backlit displays such as LCD displays (including any type of backlighting scheme), LED displays, CRT's, etc. Furthermore, it will be appreciated that although in the embodiment described herein the varying neutral color overlay brightness control aspect of the instant invention is utilized in combination with a hardware brightness (e.g. backlight brightness of an LCD) control, the varying neutral color overlay brightness control may, and in certain embodiments does, function as the sole brightness control for the device. Further still, it will be appreciated that although in the embodiment described herein the varying neutral color overlay brightness control aspect of the instant inventive concept is initiated after a minimum hardware brightness level has been obtained, the varying neutral color overlay brightness level may be, and in some embodiments is, initiated between hardware brightness dimming steps as a smooth brightness dimming transition between levels of brightness that are obtainable by the hardware.

Thus, while the present general inventive concept has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

It is also to be understood that the following claims are intended to cover all of the generic and specific features of the invention herein described, and all statements of the scope of the invention which, as a matter of language, might be said to fall therebetween. Hence, the proper scope of the present general inventive concept should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed is:

1. A method of dimming a device display of a device, said method comprising the steps of:

generating a background display of data at a first brightness level on the device display;

receiving a request to display the data at a second brightness level that is different than the first brightness level;

determining a neutral color overlay opacity value that corresponds with said second brightness level; and combining a neutral color overlay of said opacity value with said background via alpha blending to result in said second brightness level for said display, wherein said opacity value is combined with said background over every pixel of said device display.

2. The method as claimed in claim 1 wherein said neutral color overlay opacity value is stored in a database associated with values corresponding to said second brightness level.

3. The method as claimed in claim 1 wherein said request to display the data at a second brightness level is a request from a user.

4. The method as claimed in claim 3 wherein said request to display the data at a second brightness level is input by the user via a control knob or button on the device.

5. The method as claimed in claim 1 where said request to display the data at a second brightness level is a request from a auto-diming subroutine.

6. The method as claimed in claim 5 wherein said device includes a photocell for measuring ambient light around said device.

7. The method as claimed in claim 1 wherein said device is an avionics device.

8. The method as claimed in claim 1 wherein said display is an LCD display.

9. The method as claimed in claim 1 wherein said display is a backlit display.

10. The method as claimed in claim 9 wherein said backlit display include an LED backlight.

11. The method as claimed in claim 1 wherein the second brightness level is dimmer than the first brightness level.

12. The method as claimed in claim 1 wherein said determining and combining steps are performed only if a minimum hardware brightness level has been obtained.

13. The method as claimed in claim 1 where said determining and combining steps are performed between two hardware brightness levels.

* * * * *